US008751219B2

(12) United States Patent
Ho

(10) Patent No.: US 8,751,219 B2
(45) Date of Patent: Jun. 10, 2014

(54) METHOD AND RELATED DEVICE FOR SIMPLIFYING PSYCHOACOUSTIC ANALYSIS WITH SPECTRAL FLATNESS CHARACTERISTIC VALUES

(75) Inventor: Yi-Lun Ho, Taipei (TW)

(73) Assignee: ALI Corporation, Taipei (TW)

( * ) Notice: Subject to any disclaimer, the term of this patent is extended or adjusted under 35 U.S.C. 154(b) by 1270 days.

(21) Appl. No.: 12/412,382

(22) Filed: Mar. 27, 2009

(65) Prior Publication Data

US 2010/0145682 A1 Jun. 10, 2010

(30) Foreign Application Priority Data

Dec. 8, 2008 (CN) ..... 2008 1 0178895

(51) Int. Cl.

| | |
|---|---|
| ***G10L 19/00*** | (2013.01) |
| ***G10L 19/025*** | (2013.01) |
| ***G10L 19/03*** | (2013.01) |
| ***G10L 19/008*** | (2013.01) |

(52) U.S. Cl.

CPC ..... *G10L 19/025* (2013.01); *G10L 19/03* (2013.01); *G10L 19/008* (2013.01); *G10L 19/00* (2013.01)

USPC ..... 704/200.1; 704/500

(58) Field of Classification Search

CPC ..... G10L 19/00; G10L 19/02; G10L 19/03; G10L 19/008; G10L 19/025

USPC ..... 704/500–504, 200.1; 700/94; 375/254

See application file for complete search history.

(56) References Cited

U.S. PATENT DOCUMENTS

| | | | | |
|---|---|---|---|---|
| 5,812,672 | A * | 9/1998 | Herre et al. | 381/2 |
| 6,456,963 | B1 * | 9/2002 | Araki | 704/200.1 |
| 7,283,968 | B2 * | 10/2007 | Youn | 704/500 |
| 2002/0022898 | A1 * | 2/2002 | Araki | 700/94 |
| 2003/0088423 | A1 * | 5/2003 | Nishio et al. | 704/500 |
| 2003/0115052 | A1 * | 6/2003 | Chen et al. | 704/230 |
| 2003/0215013 | A1 * | 11/2003 | Budnikov | 375/240.16 |
| 2004/0002854 | A1 * | 1/2004 | Ha | 704/212 |
| 2004/0083110 | A1 * | 4/2004 | Wang | 704/500 |
| 2004/0162720 | A1 * | 8/2004 | Jang et al. | 704/200.1 |
| 2004/0181403 | A1 * | 9/2004 | Hsu | 704/230 |
| 2004/0196913 | A1 * | 10/2004 | Chakravarthy et al. | 375/254 |
| 2008/0004873 | A1 * | 1/2008 | Liu et al. | 704/229 |
| 2008/0136686 | A1 * | 6/2008 | Feiten | 341/60 |

OTHER PUBLICATIONS

Suresh et al. "Direct MDCT Domain Psychoacoustic Modeling", IEEE International Symposium on Signal Processing and Information Technology, 2007.*

(Continued)

*Primary Examiner* — Jialong He

(74) *Attorney, Agent, or Firm* — Winston Hsu; Scott Margo

(57) ABSTRACT

The present invention applies spectral flatness characteristic values to simplify psychoacoustic analysis of a sound signal. If the sound signal comprises a plurality of frames, the present invention calculates the energy of the sound signal in a frequency domain, calculates a plurality of spectral flatness, and decides to use a short-block or a long-block Modified Discrete Cosine Transform accordingly. If the sound signal comprises left and right channel signals, the present invention performs psychoacoustic analysis on the sound signal to count energy of the left and right channel signals in a frequency domain, counts spectral flatness of the left and right channel signals, and decides to use middle/side transform or left and right channel encoding to transform the left and right channel signals accordingly.

13 Claims, 8 Drawing Sheets

(56) References Cited

OTHER PUBLICATIONS

Herre et al. "Robust Matching of Audio Signals Using Spectral Flatness Features", IEEE Workshop on the application of signal processing to audio and acoustics, 2001.*

Herre et al. "MP3 Surround: Efficient and Compatible Coding of Multi-Channel Audio", Audio Engineering Society convention paper, Berlin, Germany, May 2004.*

Brandenburg, "Perceptual Coding of High Quality Digital Audio", Applications of Digital Signal Processing to Audio and Acoustics, The Kluwer International Series in Engineering and Computer Science, vol. 437, 2002.*

Ivan Dimkovic, "Improved ISO AAC coder", [online] "www.psytel-veseard.co.yu/papers/di0400I.pdf", 2004.*

* cited by examiner

METHOD AND RELATED DEVICE FOR SIMPLIFYING PSYCHOACOUSTIC ANALYSIS WITH SPECTRAL FLATNESS CHARACTERISTIC VALUES

BACKGROUND OF THE INVENTION

1. Field of the Invention

The present invention relates to a method of simplifying psychoacoustic analysis, and more particularly, to a method of simplifying psychoacoustic analysis by utilizing spectral flatness for an audio compression system.

2. Description of the Prior Art

With rapid development of electronic video products, video compression technology applied to the electronic video products is more and more important, in which the Motion Picture Experts Group (MPEG) is indeed a mainstream for the video compression.

Please refer to FIG. 1, which is a diagram of an operation process 10 of an audio encoder utilizing a video compression standard according to the prior art. An analog sound signal is transformed to a digital sound signal via pulse-code modulation (PCM) (Step 100). The digital sound signal is divided into M frequency bands in multiple frequency domains via subband filtering (Step 102), transformed to frequency domain values via modified discrete cosine transform (MDCT) (Step 104) and middle/side transform (M/S transform) (Step 106), sent to a re-quantizing module for quantizing (Step 108), and finally becomes format bitstream (Step 110). In order to compress the sound signal efficiently, the sound signal needs to be analyzed for obtaining certain parameters. Therefore, the parameters of the sound signal, such as a block type, a middle/side type (M/S type) and masking threshold, are obtained by the PCM, subband filtering, Fast Fourier Transform (FFT) (Step 112), and psychoacoustic model analysis (Step 114). The block type is an important parameter for performing the MDCT. The M/S type is an important parameter for deciding whether the M/S transform is utilized. The masking threshold is an important parameter for the re-quantizing module performing quantization.

Before the MDCT is executed, the block type needs to be determined for transforming the sound signal, namely the sound signal is suitable for a long-block or a short-block MDCT to transform. The long-block MDCT is utilized if the sound signal is a short-term stationary signal, and the short block MDCT is utilized if the sound signal has a transition, to avoid pre-echo noise.

Please refer to FIG. 2, which is a diagram of a process 20 determining a block type according to the prior art. A sound signal goes through the PCM (Step 200), long-block psychoacoustic model analysis (Step 202), and then is determined whether the short-block MDCT is utilized (Step 204). If the short-block MDCT is utilized, the sound signal re-executes the short-block MDCT (Step 206), and executes short-block psychoacoustic model analysis (Step 207). If the short-block MDCT is not utilized, the sound signal performs the M/S transform or other sound encoding (Step 208). Therefore, no matter which block type the sound signal belongs to, the long-block psychoacoustic model analysis is preset to execute in Step 202 according to the prior art. The short-block psychoacoustic model analysis is re-executed in Step 207 when the sound signal is determined to utilize the short-block MDCT in Step 204. In this situation, the calculation in Step 202 is unnecessary, and increases an amount of the calculation. Moreover, in Step 204, the perceptual entropy is usually utilized for determining whether the short-block MDCT is utilized. As a result, the short-block MDCT is utilized for transforming the sound signal when the perceptual entropy is greater than a preset value.

In addition, when spectral characteristic of left and right channel signals of the sound signal are similar, the M/S transform can remove correlation of the left and right channel signals, and then compress the sound signal, to increase efficiency of compression. For example, if the left channel signal of the sound signal is defined as L[n], and the right channel signal is defined as R[n], then the middle signal is defined as $M[n]=\sqrt{2}\times(L[n]+R[n])/2$, and the side signal is defined as $S[n]=\sqrt{2}\times(L[n]-R[n])/2$. As can be seen, the middle signal is the same part of the left and right channel signals, and the side signal is the different part of the left and right channel signals. Therefore, the M/S transform can decrease data amount and increase efficiency of compression. As a result, determining whether the spectral characteristic of the left and right channel signals are similar can determine whether the M/S transform is suitable for the sound signal.

Please refer to FIG. 3, which is a diagram of a process 30 determining characteristic of the left and right channel signals according to the prior art. In the prior art, the left and right channel signals go through the psychoacoustic model analysis (Step 300), and then are determined whether the M/S transform is suitable. If the M/S transform is suitable, the left and right channel signals are transformed by the M/S transform; otherwise, the left and right channel signals undergo sound encoding (Step 306), such as undergo quantization with re-quantizing module. Therefore, if the left and right channel signals are suitable for utilizing the M/S transform, the left and right channel signals going through the psychoacoustic model analysis in Step 300 become unnecessary, which increases an amount of calculation.

Therefore, the abovementioned processes 20 and 30 may increase an amount of the calculation, and affect efficiency of the system.

SUMMARY OF THE INVENTION

Therefore, the present invention provides a method and related device of simplifying psychoacoustic analysis by utilizing spectral flatness, for increasing efficiency of compression.

The present invention discloses a method of simplifying psychoacoustic analysis with spectral flatness characteristic values, which includes calculating energy of a plurality of frames of a sound signal in a frequency domain, calculating a plurality of spectral flatness according to the energy of the plurality of frames in the frequency domain, and using a short-block or a long-block Modified Discrete Cosine Transform (MDCT) for transforming each frame of the plurality of frames according to the plurality of spectral flatness.

The present invention further discloses an audio converter device utilized in an audio compression system, for executing the method abovementioned.

The present invention further discloses a method of simplifying psychoacoustic analysis with spectral flatness, which includes calculating energy of a left and right channel signals of a sound signal in a frequency domain, calculating spectral flatness of the left and right channel signals according to the energy of the left and right channel signals in the frequency domain, using a middle/side (M/S) transform or left and right channel encoding to transform the left and right channel signals according to the spectral flatness of the left and right channel signals.

The present invention further discloses an audio converter device utilized in an audio compression system, for executing the method abovementioned.

These and other objectives of the present invention will no doubt become obvious to those of ordinary skill in the art after reading the following detailed description of the preferred embodiment that is illustrated in the various figures and drawings.

DETAILED DESCRIPTION

The present invention discloses a method of simplifying psychoacoustic analysis with spectral flatness characteristic values, which utilizes spectral flatness for determining a block type and a middle/side type (M/S type) of a sound signal, so as to simplify execution of psychoacoustic analysis and increase efficiency of compression.

Figure 4:
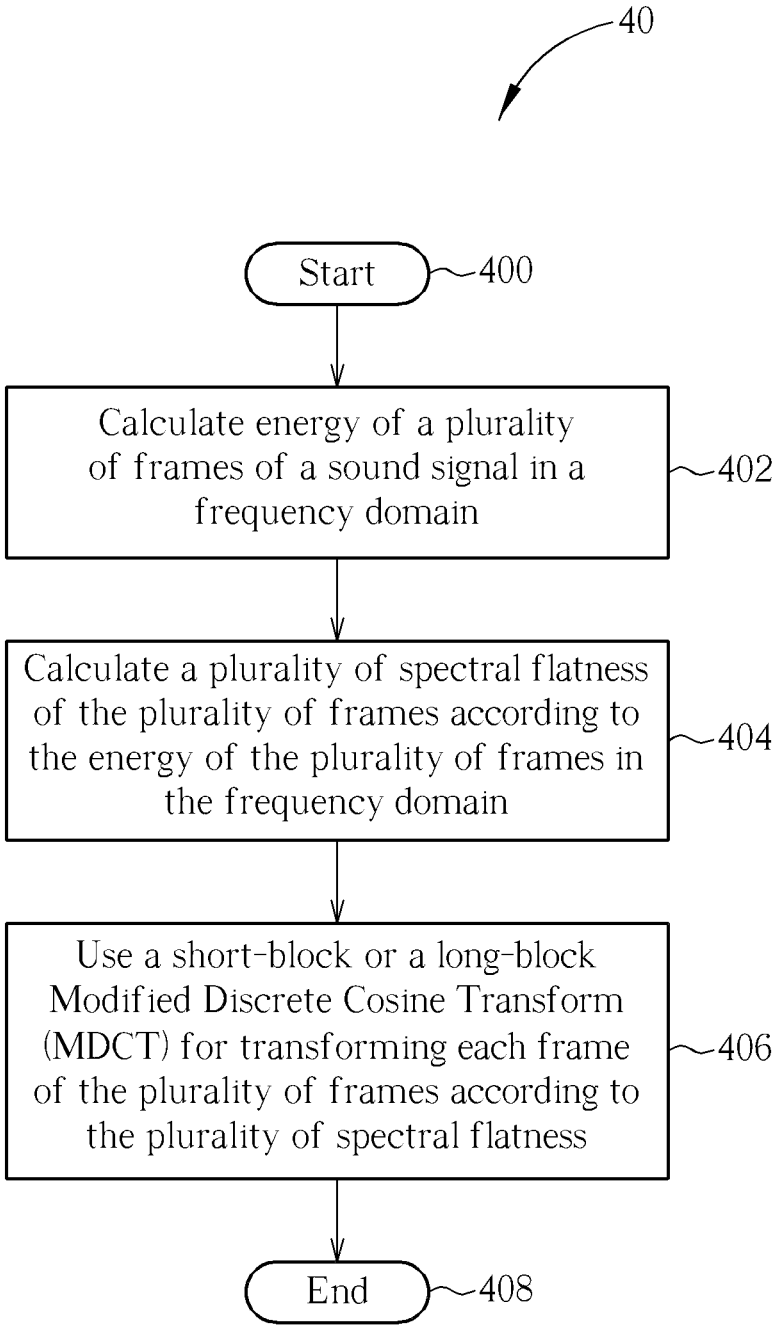
FIG. 4 is a schematic diagram of a process determining to use a short-block or a long-block MDCT to transform a frame according to an embodiment of the present invention.

Please refer to FIG. 4, which is a schematic diagram of a process 40 according to an embodiment of the present invention. The process 40 utilizes spectral flatness for simplifying psychoacoustic analysis, which includes the following steps:

Step 400: Start.

Step 402: Calculate energy of a plurality of frames of a sound signal in a frequency domain.

Step 404: Calculate a plurality of spectral flatness of the plurality of frames according to the energy of the plurality of frames in the frequency domain.

Step 406: Use a short-block or a long-block Modified Discrete Cosine Transform (MDCT) for transforming each frame of the plurality of frames according to the plurality of spectral flatness.

Step 408: End.

Figure 1:
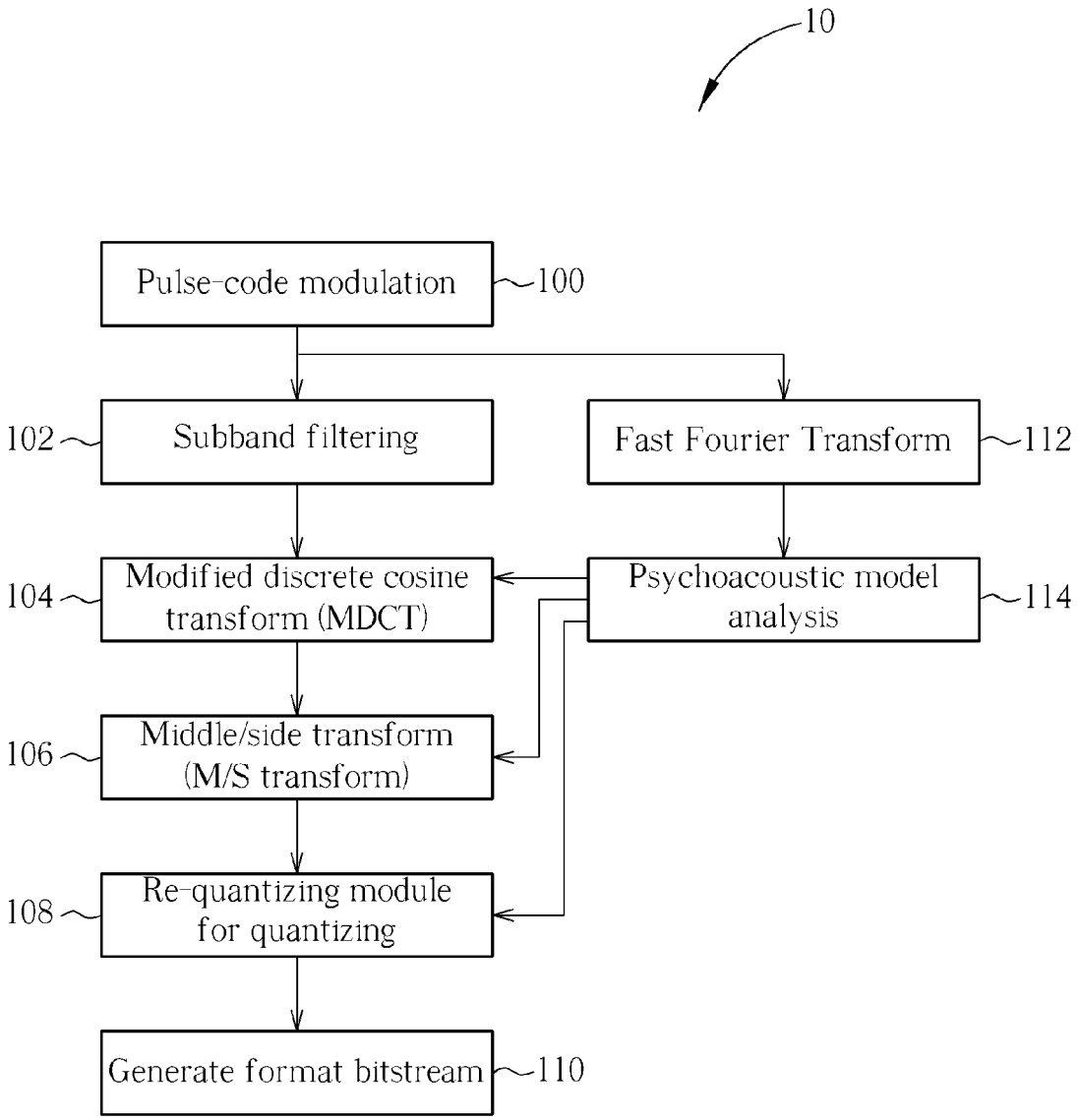
FIG. 1 PRIOR ART
FIG. 1 is a schematic diagram of an operation process of an audio encoder utilizing video compression standard according to the prior art.
Figure 2:
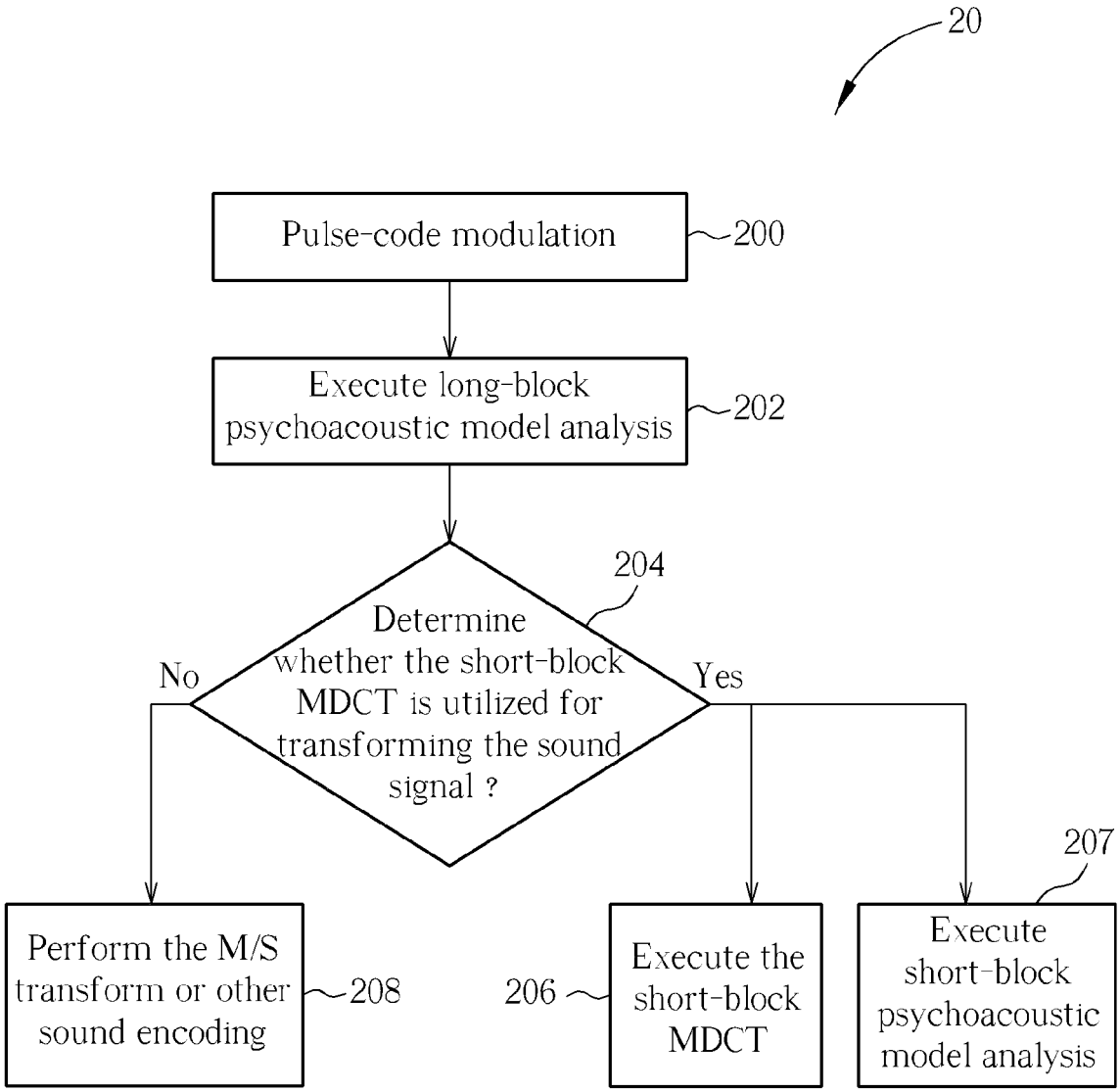
FIG. 2 PRIOR ART
FIG. 2 is a schematic diagram of a process determining a block type according to the prior art.

According to the process 40, the embodiment of the present invention calculates the energy of the frames of a sound signal in a frequency domain, and calculates the spectral flatness of the frames according to the energy, so as to determine to use the short-block or the long-block MDCT to transform each frame. Therefore, by utilizing the calculation of the spectral flatness, the sound signal can be determined to use the short-block or the long-block MDCT for transform. Moreover, if the sound signal uses the short-block MDCT for transform in Step 204, the calculation in Step 202 becomes unnecessary, so as to increase efficiency of compression and simplify twice psychoacoustic analysis (as shown in FIG. 2) to once.

In Step 402, the sound signal goes through pulse-code modulation (PCM), proper filtering, subband filtering or Fast Fourier Transform (FFT), etc. for obtaining parameters of the energy of the plurality frames of the sound signal in the frequency domain. Take subband filtering as an example, a frame is defined as a[t], t=0~(N−1), and divided into M frequency bands by subband filtering, in which each frequency band marked as A[0][k], A[1][k], A[2][k] . . . A[M−1][k], k=0~(N/M−1). Therefore, parameters of the energy of the plurality frames can be indicated as an energy sequence A_ene[m]. In Step 404, by utilizing the parameters of the energy, the spectral flatness of the frame a[t] is obtained through the energy sequence A_ene[m] by the following formula (A):

$$\text{Spectral flatness} = \sqrt[m]{\frac{\text{A_ene}[0]\cdot\text{A_ene}[1]\ \ldots\ \text{A_ene}[M-1]}{\frac{1}{M}\sum_{m=0}^{M-1}\text{A_ene}[m]}} \quad \text{(A)}$$

Figure 5:
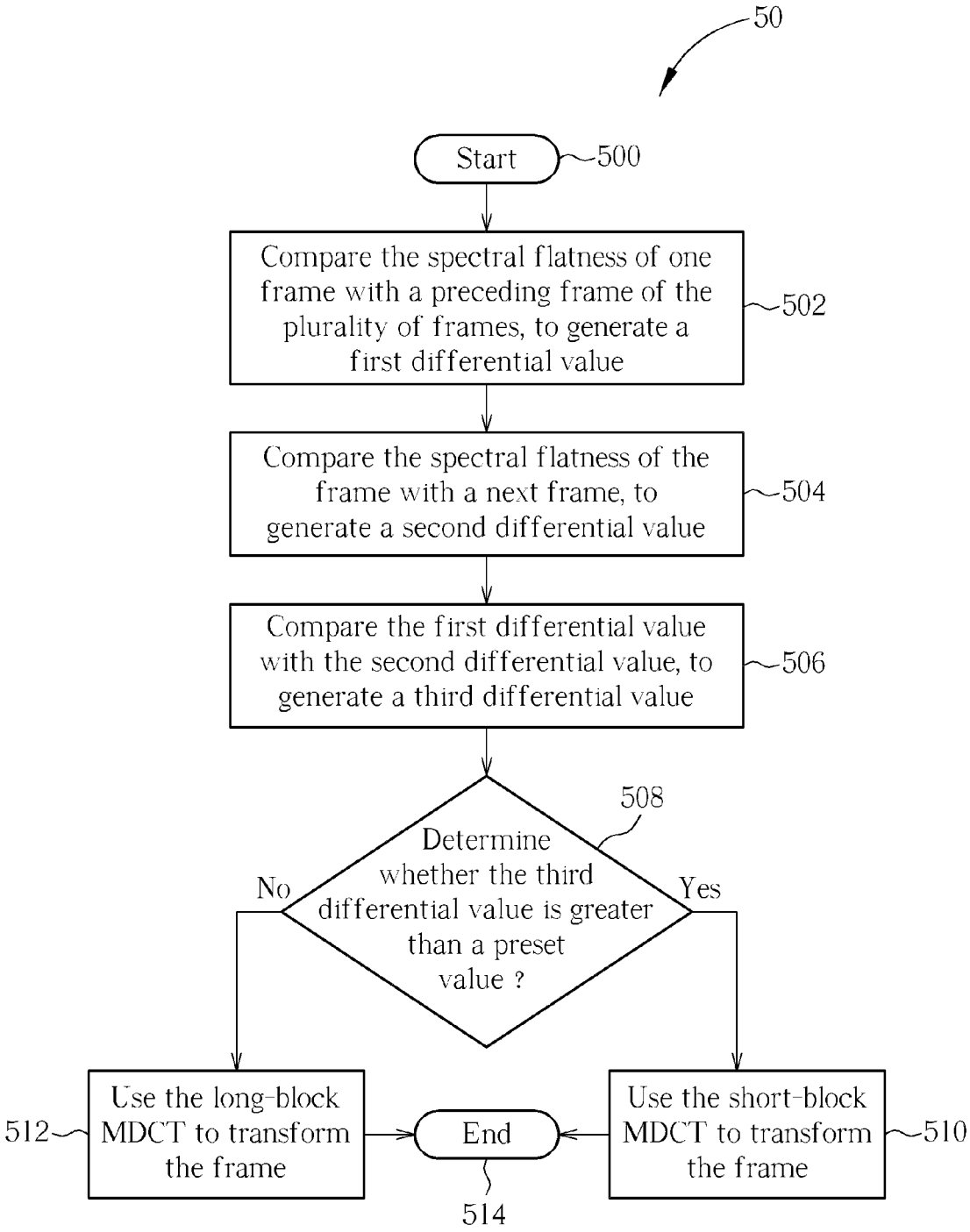
FIG. 5 is a schematic diagram of a process comparing spectral flatness of a plurality of frames according to an embodiment of the present invention.

Finally, in Step 406, the frames are transformed by short-block or long-block MDCT according to the spectral flatness. A detailed operation method related to Step 406 is shown in FIG. 5. FIG. 5 is a schematic diagram of a process 50 according to an embodiment of the present invention, which includes the following steps:

Step 500: Start.

Step 502: Compare the spectral flatness of one frame with a preceding frame of the plurality of frames, to generate a first differential value.

Step 504: Compare the spectral flatness of the frame with a next frame, to generate a second differential value.

Step 506: Compare the first differential value with the second differential value, to generate a third differential value.

Step 508: Determine whether the third differential value is greater than a preset value. If yes, perform Step 510; otherwise perform Step 512.

Step 510: Use the short-block MDCT to transform the frame.

Step 512: Use the long-block MDCT to transform the frame.

Step 514: End.

Figure 6:
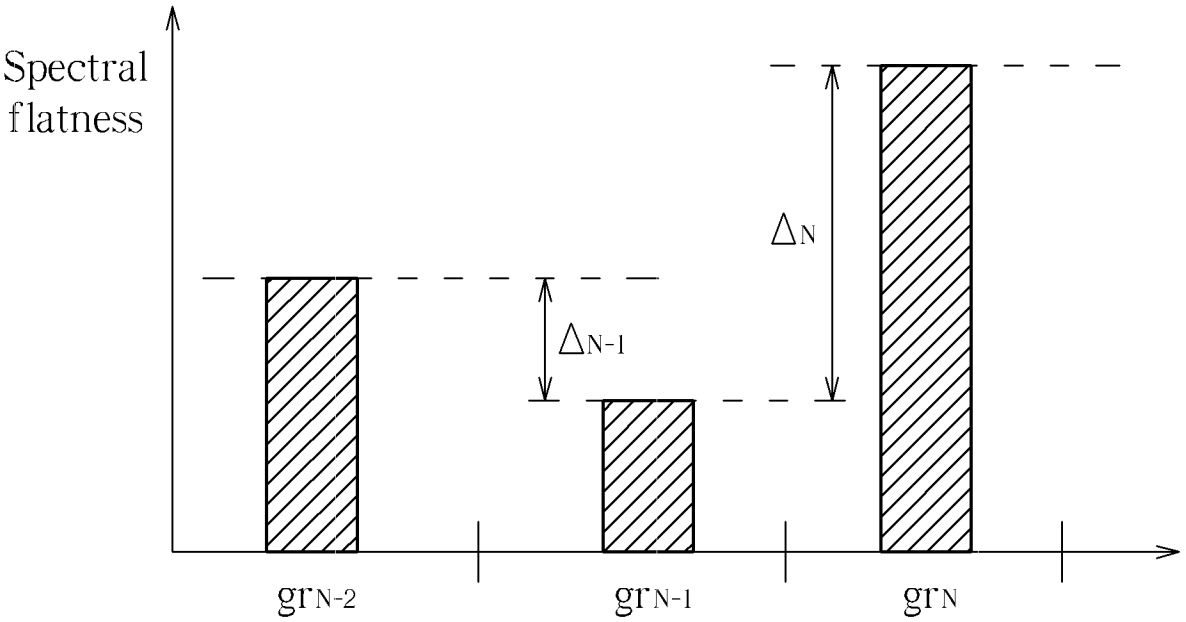
FIG. 6 is a schematic diagram of spectral flatness of frames.

Please refer to FIG. 6 for illustration of the process 50. As shown in FIG. 6, a frame is defined as $gr_{N-1}$, a preceding frame is defined as $gr_{N-2}$, and a next frame is defined as $gr_N$. In Step 502, the spectral flatness of the frame $gr_{N-1}$ is compared to the spectral flatness of the preceding frame $gr_{N-2}$, to obtain an absolute value, namely a first differential value $\Delta_{N-1}$. Similarly, in Step 504, the spectral flatness of the frame $gr_{N-1}$ is compared to the spectral flatness of the next frame $gr_N$, to obtain an absolute value, namely a second differential value $\Delta_N$. Then, in Step 506, the first differential value is compared to the second differential value, to generate an absolute third differential value $|\Delta_N-\Delta_{N-1}|$. If the third differential value $|\Delta_N-\Delta_{N-1}|$ is greater than a preset value, which indicates the frame $gr_{N-1}$ has a transition, the short-block MDCT is used to transform the frame $gr_{N-1}$ as described in Step 510. On the contrary, If the third differential value $|\Delta_N-\Delta_{N-1}|$ is smaller than the preset value, which indicates that the frame $gr_{N-1}$ is a short-term stationary signal, the long-block MDCT is used to transform the frame $gr_{N-1}$ as described in Step 512.

As mentioned above, the first differential value $\Delta_{N-1}$ and the second differential value $\Delta_N$ indicate a variance of the frame $gr_{N-1}$ and the preceding frame $gr_{N-2}$, and a variance of the frame $gr_{N-1}$ and the next frame $gr_N$. Certainly, besides utilizing the absolute value, a logarithm value can be utilized for the spectral flatness of the frames. For example, the first differential value $\Delta_{N-1}$ is an absolute value of a variance of logarithm values of the spectral flatness of the frame $gr_{N-1}$ and the preceding frame $gr_{N-2}$, and the second differential value $\Delta_N$ is an absolute value of a variance of logarithm values of the spectral flatness of the frame $gr_{N-1}$ and the next frame $gr_N$. In this situation, the preset value could be set to 3, which is not limited herein. Certainly, a way of comparing the spectral flatness of each frame abovementioned is only an embodiment, which is not limited herein, and values related to the spectral flatness comparison, such as the preset value, could be modified accordingly.

Therefore, the present invention utilizes the spectral flatness for determining the block type of a frame, and decides to use the short-block or the long-block MDCT for transforming the frame, thereby efficiency of compression is increased by simplifying twice psychoacoustic analysis (as shown in FIG. 2) in the prior art to once.

Note that, in Step 402, the frames is defined as a[t], t=0~(N−1) if parameters of the energy of the plurality of frames in the frequency domain included in the sound signal is obtained by FFT; then, the frame a[t] is transformed by FFT, to obtain a complex sequence A[n]+B[n]*i, n=0~(N/2−1) in the frequency domain, where A[n] is a real part of the complex sequence, B[n] is an imaginary part of the complex sequence, and i is an imaginary root; finally, an energy sequence A_ene [n]=A[n]*A[n]+B[n]*B[n], n=0~(N/2−1) of the frame a[t] is calculated.

Figure 7:
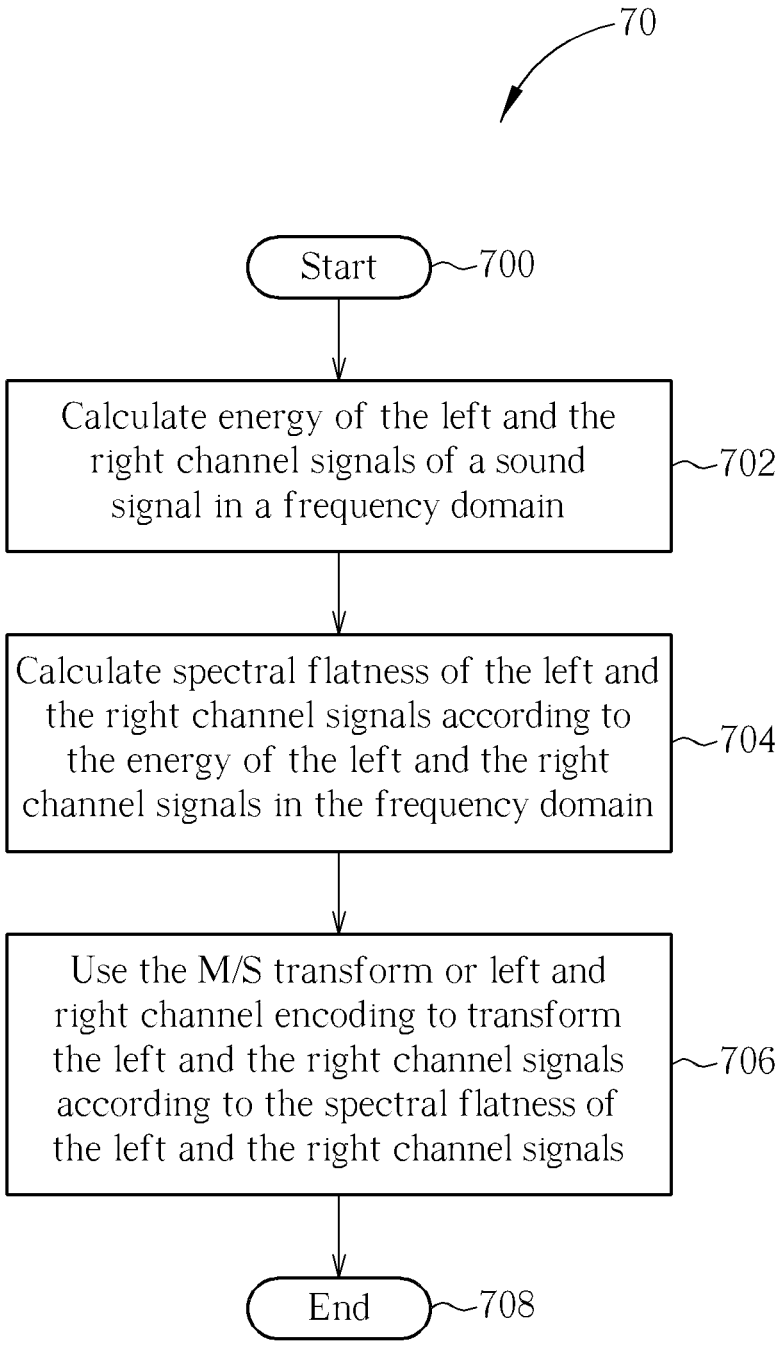
FIG. 7 is a schematic diagram of a process determining to use a M/S transform or left and right channel encoding for transforming a left and a right channel signals according to an embodiment of the present invention.

In addition, for a stereo sound signal transform, please refer to FIG. 7, which is a schematic diagram of a process 70 according to an embodiment of the present invention. The process 70 utilizes spectral flatness for simplifying psychoacoustic analysis, which includes the following steps:

Step 700: Start.

Step 702: Calculate energy of the left and the right channel signals of a sound signal in a frequency domain.

Step 704: Calculate spectral flatness of the left and the right channel signals according to the energy of the left and the right channel signals in the frequency domain.

Step 706: Use the M/S transform or left and right channel encoding to transform the left and the right channel signals according to the spectral flatness of the left and the right channel signals.

Step 708: End.

Similar to the process 40, the process 70 decides the transform method of the stereo signal according to the spectral flatness. The process 70 calculates the energy of the left and right channel signals of the sound signal in the frequency domain, and determines to use M/S transform or the left and right channel encoding to transform the left and right channel signals according to the calculated spectral flatness of the left and right channel signals.

In Step 702, the sound signal goes through PCM and proper filtering, such as subband filtering or FFT, etc. for obtaining the parameters of energy of the left and right channel signals of the sound signal in the frequency domain. Take the subband filtering as an example, the left or right channel signal is defined as c[t], t=0~(N−1); the left or right channel signal c[t] is divided into M frequency bands by subband filtering, where each frequency band marked as C[0][k], C[1][k], C[2][k] . . . C[M−1][k],k=0~(N/M−1). Therefore, the energy sequence C_ene[m] indicates the parameters of the energy of the left or the right channel signal in frequency domain. In addition, Step 702 of an embodiment of the present invention utilizes FFT for obtaining the parameters of the energy of the plurality of frames of the sound signal in frequency domain. Suppose the left or right channel signal is defined as c[t], t=0~(N−1); the left or the right channel signal c[t] using is transformed by FFT, to obtain a complex sequence C[n]+D[n]*i, n=0~(N/2−1) in the frequency domain, where C[n] is a real part of the complex sequence, D[n] is an imaginary part of the complex sequence, and i is an imaginary root; finally, an energy sequence C_ene[n]=C[n]*C[n]+D[n]*D[n],n=0~(N/2−1) of the left or the right channel signal c[t] is calculated.

In the embodiment of the present invention utilizing subband filtering for obtaining the parameters of energy of the left and right channel signals of the sound signal in the frequency domain, Step 704 uses the parameters of energy for calculating the spectral flatness of the left and right channel signals. Please refer to the following formula (B) for calculation of the spectral flatness.

$$\text{Spectral flatness} = \sqrt[m]{\frac{\text{C_ene}[0]\cdot\text{C_ene}[1]\ \ldots\ \text{C_ene}[M-1]}{\frac{1}{M}\sum_{m=0}^{M-1}\text{C_ene}[m]}} \quad \text{(B)}$$

Finally, in Step 706, the left and right channel signals are determined to undergo the M/S transform or left and right channel encoding according to the spectral flatness of the left and right channel signals. The M/S transform is used to transform the left and right channel signals when a variation of spectral flatness of the left and the right channel signals is smaller than a preset value. The left and right channel encoding is used to transform the left and the right channel signals when a variation of spectral flatness of the left and the right channel signals is greater than the preset value. Preferably, after the present invention calculates and obtains the logarithm values of the spectral flatness of the left and right channel signals, the present invention compares the absolute value of the variance of the logarithm value of the spectral flatness of the left and right channel signals. The M/S transform is used to transform the left and right channel signals if an absolute variation is smaller than 5, which means spectral of the left and the right channels are similar. The left and right channel encoding are used to transform the left and right channel signals if the absolute variation is greater than 5. Certainly, a way of comparing the spectral flatness of the left and the right channels abovementioned is only an embodiment, which is not limited herein, and values related to the spectral flatness comparison, such as the preset value, could be modified accordingly.

Figure 3:
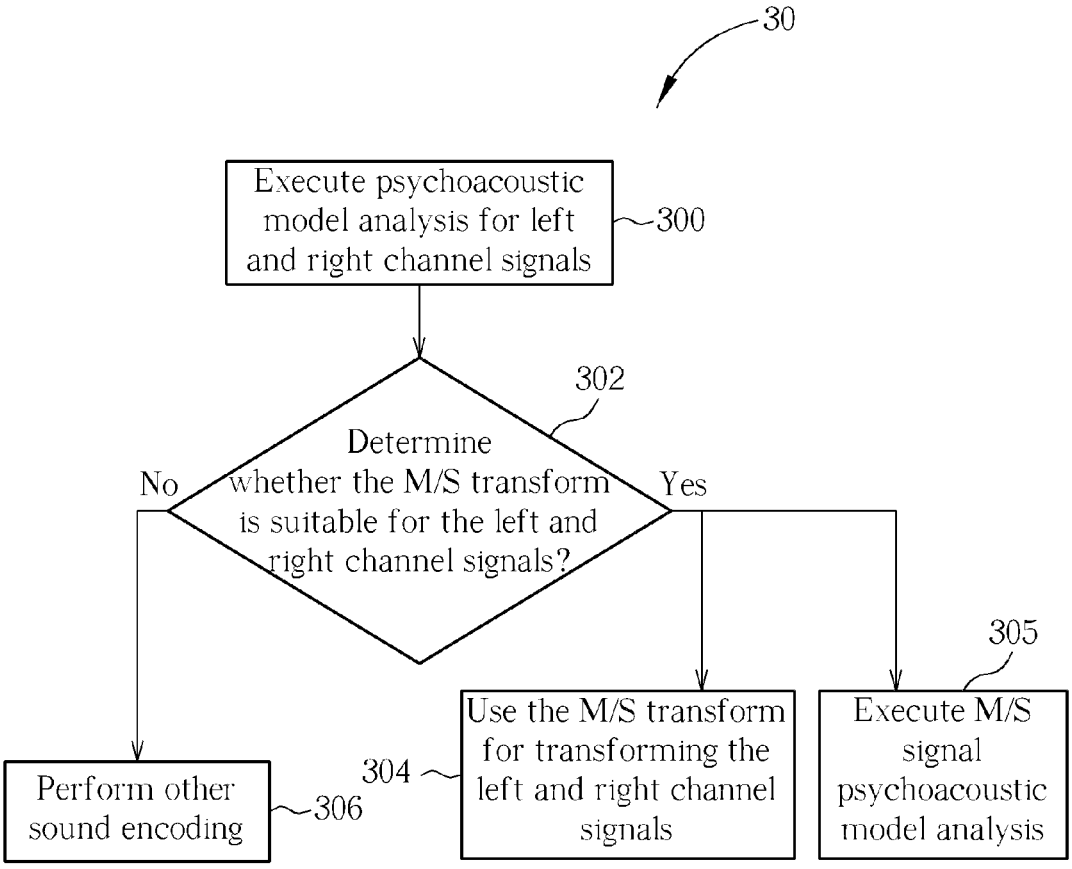
FIG. 3 PRIOR ART
FIG. 3 is a schematic diagram of a process determining characteristics of a left and a right channel signals according to the prior art.

Therefore, the present invention utilizes the spectral flatness for determining variance of the left and right channel signals, and determining whether using the M/S transform to transform the left and right channel signals. Therefore, when Step 302 as shown in FIG. 3 determines the M/S transform is suitable for the left and right channel signals, psychoacoustic analysis in Step 300 is unnecessary, so the present invention can increase efficiency of compression and simplify twice psychoacoustic analysis (as shown in FIG. 3) in the prior art to once.

In FIG. 4, the present invention utilizes "spectral flatness characteristic values" for obtaining correlation of the preceding frame and the next frame in the same channel, to simplify the process of compressing sound signal and the number of psychoacoustic analysis. In FIG. 7, the present invention utilizes "spectral flatness characteristic values" for obtaining correlation of frames of the left and the right channels, to simplify the process of compressing sound signal and the number of psychoacoustic analysis. Note that, FIG. 4 and FIG. 7 are only embodiments of the present invention, and the present invention can utilize "spectral flatness characteristic values" for simplifying steps of the process of sound signal compression.

Figure 8:
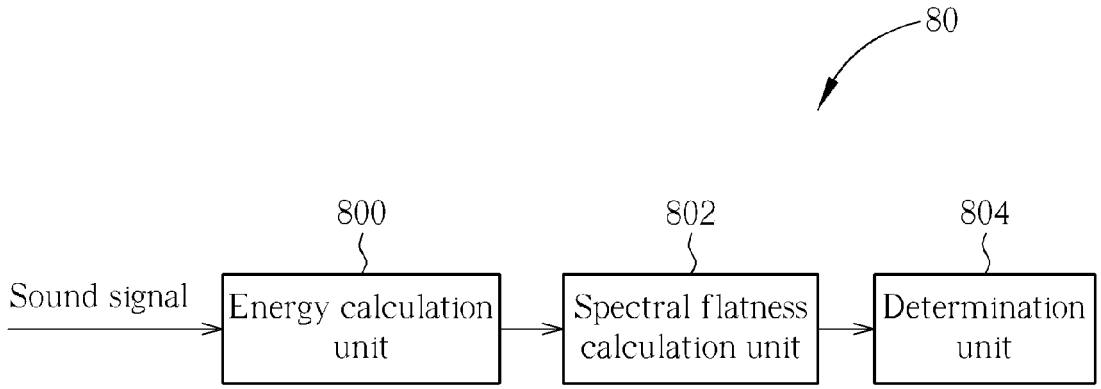
FIG. 8 is a schematic diagram of an electronic device according to an embodiment of the present invention.

On the other hand, as to the sound signal transform shown in FIG. 4 or FIG. 7, those skilled in the art can realize an electrical device of simplifying psychoacoustic analysis by utilizing the spectral flatness. For example, please refer to FIG. 8, which is schematic diagram of an electronic device 80 according to an embodiment of the present invention. The electronic device 80 is used for utilizing the spectral flatness to simplify psychoacoustic analysis, which includes an energy calculation unit 800, a spectral flatness calculation unit 802, and a determination unit 804. The electronic device 80 is used for realizing the process 40, where the energy calculation unit 800, the spectral flatness calculation unit 802 and the determination unit 804 respectively executes Steps 402, 404, and 406. Certainly, those skilled in the art can make alternations and modifications accordingly. For example, the energy calculation unit 800 utilizes subband filtering or FFT for obtaining parameters of the energy of the plurality frames of the sound signal in the frequency domain. If the energy calculation unit 800 utilizes subband filtering for obtaining parameters of the energy of the plurality frames of the sound signal in the frequency domain, the spectral flatness calculation unit 802 utilizes the formula (A) for obtaining the spectral flatness. After the spectral flatness is obtained, the determination unit 804 compares the spectral flatness of a frame with a preceding frame, to generate a first differential value, compares the spectral flatness of the frame and a next frame, to generate a second differential value, and finally compares the first differential value with the second differential value, to generate a third differential value for determining to use the short-block or long-block MDCT transforming the frame. For example, if the third differential value is greater than a preset value, the frame is transformed by the short-block MDCT; otherwise, the frame is transformed by the long-block MDCT. Abovementioned operation can be referred in the processes 40 and 50, so the detailed description is omitted herein.

Similarly, the electronic device 80 can be a model for an electronic device to realize the process 70 shown in FIG. 7, and a related realizing method shall be fairly know for people having ordinary skill in the art, so the detailed description is omitted herein In conclusion, the present invention utilizes the spectral flatness for determining the block type of a frame, and decides to use the short-block or the long-block MDCT for transforming the frame. Meanwhile, the present invention utilizes the spectral flatness for determining variance of the left and right channel signals, and determining whether using the M/S transform to transform the left and the right channel signals. Therefore, a process of determining the block type and characteristics of the left and right channel signals in the present invention simplifies the number of execution, and increases efficiency of compression, so as to realize the goal of the present invention.

Those skilled in the art will readily observe that numerous modifications and alterations of the device and method may be made while retaining the teachings of the invention.

What is claimed is:

1. A method of simplifying psychoacoustic analysis with spectral flatness characteristic values comprising:

calculating energy of a plurality of frames of a sound signal in a frequency domain;

calculating a plurality of spectral flatness according to the energy of the plurality of frames in the frequency domain; and determining whether to use a short-block or a long-block Modified Discrete Cosine Transform (MDCT) for transforming each frame of the plurality of frames according to differential values between a portion of spectral flatness of adjacent frames among the plurality of spectral flatness.

2. The method of claim 1, wherein the step of determining whether to use the short-block or the long-block MDCT for transforming each frame of the plurality of frames according to the plurality of spectral flatness comprises:

comparing the spectral flatness of one frame with a preceding frame of the plurality of frames to generate a first differential value;

comparing the spectral flatness of the frame with a next frame to generate a second differential value;

comparing the first differential value with the second differential value to generate a third differential value; and determining whether to use the short-block or the long-block MDCT to transform the frame according to the third differential value.

3. The method of claim 2, wherein the step of determining whether to use the short-block or long-block MDCT to transform the frame according to the third differential value further comprises:

using the short-block MDCT to transform the frame when the third differential value is greater than a preset value; and using the long block MDCT to transform the frame when the third differential value is smaller than the preset value.

4. The method of claim 2, wherein the first differential value is acquired by comparing logarithm values of the spectral flatness of the frame with the preceding frame, and the second differential value is acquired by comparing logarithm values of the spectral flatness of the frame with the next frame.

5. The method of claim 1, wherein the step of calculating the energy of the frame in the frequency domain comprises:

defining the frame as a[t] and t=0 to (N−1);

using Fast Fourier Transform (FFT) to transform the frame a[t] to obtain a sequence in the frequency domain wherein the sequence is A[n]+B[n]*i and n=0 to (N/2−1);

calculating an energy sequence of the frame wherein the energy sequence is A_ene[n]=A[n]*A[n]+B[n]*B[n] and n=0 to (N/2−1).

6. The method of claim 1, wherein the step of calculating the energy of the frame in the frequency domain comprises:

defining the frame as a[t] and t=0 to (N−1);

dividing the frame a[t] into M frequency bands by subband filtering, each frequency band marked as A[0][k], A[1][k], A[2][k] . . . A[M−1][k] and k=0 to (N/M−1);

calculating an energy sequence of the frame wherein the energy sequence is A_ene[m]=sum(A[m][0]*A[m][0]+A[m][1]*A[m][1] . . . ) and m=0 to (M−1).

7. The method of claim 6, wherein spectral flatness of the frame a[t] is obtained through the energy sequence A_ene[m] by a formula:

$$\text{Spectral flatness} = \sqrt[m]{\frac{\text{A_ene}[0] \cdot \text{A_ene}[1] \ldots \text{A_ene}[M-1]}{\frac{1}{M}\sum_{m=0}^{M-1} \text{A_ene}[m]}}.$$

8. A method of simplifying psychoacoustic analysis with spectral flatness comprising:

calculating energy of a left and a right channel signals of a sound signal in a frequency domain;

calculating spectral flatness of the left and the right channel signals according to the energy of the left and the right channel signals in the frequency domain;

determining whether to use a middle/side (M/S) transform or left and right channel encoding to transform the left and the right channel signals according to a variation of the spectral flatness of the left and the right channel signals.

9. The method of claim 8, wherein the step of determining whether to use the M/S transform or the left and right channel encoding to transform the left and the right channel signals according to a variation of the spectral flatness of the left and the right channel signals comprises:

using the M/S transform to transform the left and the right channel signals when a variation of spectral flatness of the left and the right channel signals is smaller than a preset value; and using the left and right channel encoding to transform the left and the right channel signals when a variation of spectral flatness of the left and the right channel signals is greater than the preset value.

10. The method of claim 9, wherein the variation of spectral flatness of the left and the right channel signals is a difference between logarithm values of spectral flatness of the left and the right channel signals, and the preset value is 5.

11. The method of claim 8, wherein the step of calculating the energy of the left or the right channel signals in the frequency domain comprises:

defining the left or right channel signal as c[t] and t=0 to (N−1);

using Fast Fourier Transform (FFT) to transform the left or the right channel signal c[t], to obtain a sequence in the frequency domain wherein the sequence is C[n]+D[n]*i and n=0 to (N/2−1);

calculating an energy sequence of the left or the right channel signal wherein the energy sequence is C_ene[n] =C[n]*C[n]+D[n]*D[n] and n=0 to (N/2−1).

12. The method of claim 8, wherein the step of calculating the energy of the left or the right channel signal in the frequency domain comprises:

defining the left or the right channel signal as c[t] and t=0 to (N−1);

dividing the left or the right channel signal c[t] into M frequency bands by subband filtering, each frequency band marked as C[0][k], C[1][k], C[2][k] . . . C[M−1][k] and k=0 to (N/M−1);

calculating an energy sequence of the left or the right channel signal wherein the energy sequence is C_ene [m]=sum(C[m][0]*C[m][0]+C[m][1]*C[m][1] . . . ) and m=0 to (M−1).

13. The method of claim 12, wherein spectral flatness of the left or the right channel signal c[t] is obtained through the energy sequence C_ene[m] by a formula:

$$\text{Spectral flatness} = \sqrt[m]{\frac{\text{C_ene}[0] \cdot \text{C_ene}[1] \ldots \text{C_ene}[M-1]}{\frac{1}{M}\sum_{m=0}^{M-1} \text{C_ene}[m]}}.$$

* * * * *